US006838826B2

(12) United States Patent
Lin et al.

(10) Patent No.: US 6,838,826 B2
(45) Date of Patent: Jan. 4, 2005

(54) DISCHARGE ELECTRODE STRUCTURE OF PLASMA DISPLAY PANEL

(75) Inventors: Chun-Hsu Lin, Taipei Hsien (TW); Wen-Rung Huang, Tainan (TW); Kuang-Lang Chen, Chungli (TW); Sheng-Chi Lee, Taipei (TW)

(73) Assignee: Chunghwa Picture Tubes, Ltd. (TW)

( * ) Notice: Subject to any disclaimer, the term of this patent is extended or adjusted under 35 U.S.C. 154(b) by 166 days.

(21) Appl. No.: 10/352,550

(22) Filed: Jan. 28, 2003

(65) Prior Publication Data

US 2004/0145315 A1 Jul. 29, 2004

(51) Int. Cl.[7] ..... H01J 17/49
(52) U.S. Cl. ..... 313/582; 313/584
(58) Field of Search ..... 313/582, 584, 313/491, 631

(56) References Cited

U.S. PATENT DOCUMENTS 6,288,488 B1 9/2001 Amemiya ..... 313/582
6,445,120 B1 * 9/2002 Kim et al. ..... 313/491

* cited by examiner

*Primary Examiner*—Vip Patel
(74) *Attorney, Agent, or Firm*—Hayes Soloway P.C.

(57) ABSTRACT

A discharge electrode structure of a plasma display panel is described. The discharge electrode structure includes a plurality of expanding electrodes or expanding portions that each one has a symmetric structure. The expanding electrodes are alternately coupled to a pair of conductive electrodes that are on the edge of a plurality of luminant cells in one row. Therefore, oblique symmetric electrodes are disposed at opposite corner location of each luminant cell.

19 Claims, 4 Drawing Sheets

DISCHARGE ELECTRODE STRUCTURE OF PLASMA DISPLAY PANEL

BACKGROUND OF THE INVENTION

1. Field of Invention

The present invention relates to a plasma display panel (PDP), and more particularly to an 180° rotation symmetric discharge electrode structure of a plasma display panel.

2. Description of Related Art

Since the field of multimedia applications is developing quickly, the user has a great demand for entertainment equipment. Conventionally, the cathode ray tube (CRT) display, which is a species of monitor, is commonly used. However, the cathode ray tube display does not meet the needs of multimedia technology because of having a large volume. Therefore, many flat panel display techniques such as liquid crystal display (LCD), plasma display panel (PDP), and field emission display (FED) have been recently developed. These display techniques can manufacture a thin, light, short and small monitor, and thus these techniques are going to be the mainstream technology for the future. In these techniques, the plasma display panel (PDP) is attracting attention in the field of displays as a full-color display apparatus having a large size display area and is especially popularly utilized in a large size television or an outdoor display panel. This is because of its capability of a high quality display resulting from the fact that it is of a self-light emitting type with a wide angle of visibility and high speed of response as well as it is suited to upsizing since its simplicity in the manufacturing process.

A color PDP is a display in which ultraviolet rays are produced by gas discharge to excite phosphors so that visible lights are emitted therefrom to perform a display operation. Generally, a 3-electrode type PDP including a common electrode, a scan electrode and an address electrode is employed in the AC type PDP.

In a conventional 3-electrode AC type PDP, the address electrodes are disposed between parallel barrier ribs on a back substrate. A plurality pair of conductive electrodes are parallel arranged, and each pair of the conductive electrodes, including the common electrode and the scan electrode, is disposed in a direction perpendicular to the address electrodes and barrier ribs, thereby a plurality of luminant cells are scaled therein.

The common and scan electrodes are generally includes a transparent electrode and a bus electrode. The transparent electrode is formed by the material of ITO (e.g., a mixture of indium oxide $In_2O_3$ and tin oxide $SnO_2$). The conductivity of the transparent electrode is low in comparison with that of metal and therefore a narrow width and fine conductive layer is added as the bus electrode on the transparent electrode to enhance its conductivity. Whereas, the gap between the common electrode and scan electrode is set in a small distance to obtain preferred fire voltage. A sustaining voltage is applied to the common electrode and the scan electrode to drive the PDP. However, the sustaining voltage consumes lots of power to charge up the electrodes because the small gap between the common electrode and scan electrode produces a large capacitance effect therebetween, and therefore reduces the whole efficiency.

When the PDP is in the state of sustain discharge, the common electrode and the scan electrode symmetrical to each other from the left side to the right side may form an electrical field in the y-z direction to accelerate the charged particles. The pattern of the Ribs in the conventional PDP is a bar chart. Therefore, there is no any rib building in the y direction to stop the charged particless. In other words, these accelerated electrodes are easily to reach to the adjacent luminant cells to affect their discharge state. This will result in error discharge situation.

SUMMARY OF THE INVENTION

It is therefore an object of the present invention to provide a discharge electrode structure of a plasma display panel in which an oblique symmetric electrode structure at opposite corners in each luminant cell to accelerate ionized particles in a tiled direction that decreases the probability of error discharge.

It is another object of the present invention to provide a discharge electrode structure of a plasma display panel in which the distance between the common electrode and scan electrode can be kept the same or the contact plate area can be smaller to diminish the capacitance effect without deteriorating luminous efficiency and drive characteristic.

In one aspect, the present invention provides a discharge electrode structure of a plasma display panel to control gas discharge of a plurality of luminant cells in one row. The discharge electrode structure comprises a pair of conductive electrodes parallel located on the edge of the luminant cells. A plurality of expanding electrodes is located between the pair of conductive electrodes. Each of the expanding electrodes is located between the luminant cells. The expanding electrodes are alternately coupled to the conductive electrodes to oblique symmetrically locate at opposite corners of each luminant cell.

In another aspect, the present invention provides a discharge electrode structure of a plasma display panel to control gas discharge of a plurality of luminant cells in one row. The discharge electrode structure comprises a pair of conductive electrodes and a pair of meandrous transparent electrodes. The pair of conductive electrodes is located parallel on the edge of the luminant cells in row. The pair of conductive electrodes includes a plurality of expanding portions alternately expanded from the conductive electrodes and located between the luminant cells. The pair of meandrous transparent electrodes includes a plurality of connecting portions and a plurality of discharge portions. The connecting portions are connected to parts of the conductive electrodes between the expanding portions. Each of the discharge portions is connected to the expanding portion and adjacent connecting portion to oblique symmetrically located at opposite corners of each luminant cell.

BRIEF DESCRIPTION OF THE DRAWINGS

These and other features, aspects, and advantages of the present invention will become better understood with regard to the following description, appended claims, and accompanying drawings, wherein:

DESCRIPTION OF THE PREFERRED EMBODIMENTS

The present invention provides a discharge electrode structure of a plasma display panel in which an oblique symmetric electrode structure is formed at opposite corners in each luminant cell. The ionized particles in each luminant cell are accelerated in a direction tilted to the perpendicular axis. Hence, the accelerated particles can be blocked down without scattering to adjacent non-luminant region, and thereby error discharge issue can be decreased.

The present invention provides several preferred embodiments to make the invention become better understood with regard to the following description. It is apparent to a person of ordinary skill in the art to modify the structure of the present invention without departing from the scope or spirit of the invention.

Figure 1:
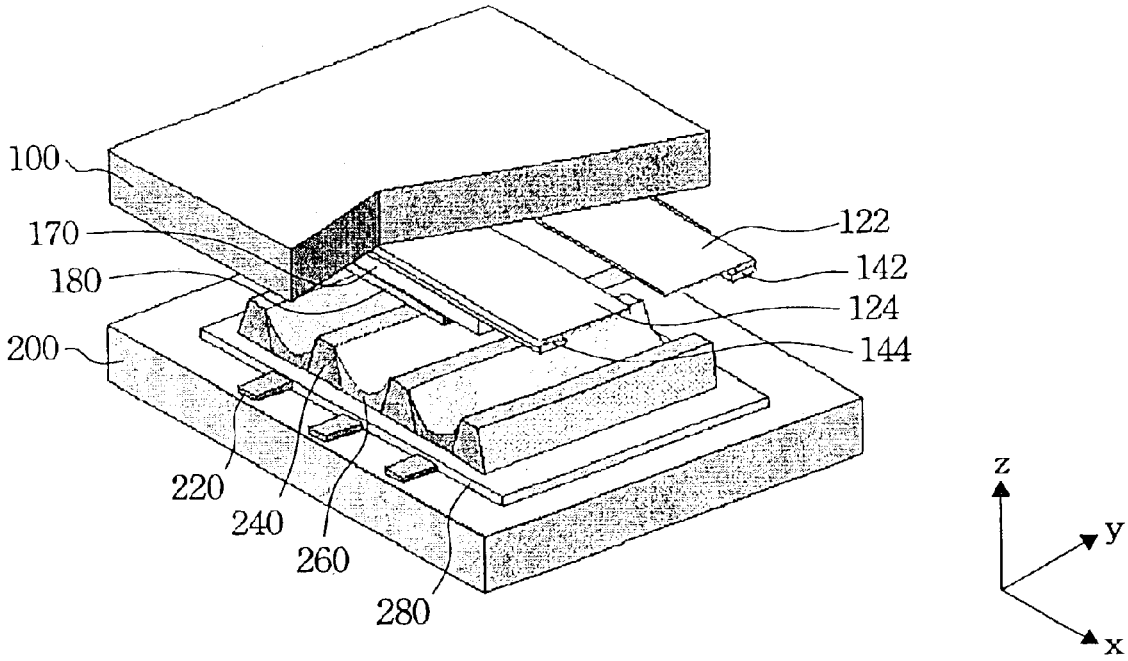
FIG. 1 is a schematic perspective view of a plasma display panel according to the prior art.

FIG. 1 is a schematic perspective view of a plasma display panel in accordance with the prior art. Referring to FIG. 1, the plasma display panel at least comprises a front substrate 100 and a back substrate 200. A plurality of parallel arranged address electrodes 220 is formed on the back substrate 200, and a dielectric layer 280 is formed over the substrate 200 to cover the address electrodes 220. A plurality of parallel arranged barrier ribs 240 respectively disposed between the address electrodes 220 are formed on the dielectric layer 280. Of course, variant structure of the barrier ribs 240 can be employed, but not limited to strip-like barrier ribs 240 as shown in FIG. 1. A fluorescent layer 260 is coated over the exposed surface between the barrier ribs 240. In the interior of the front substrate 100, a plurality of transparent electrodes 122, 124 is formed thereon. At least one pair of transparent electrodes 122, 124 is located on the luminant cells in one row. The transparent electrodes 122, 124 respectively have opaque electrodes 142, 144 as describe above. A dielectric layer 160 and a protective layer 180 are formed to cover the opaque electrodes 142, 144 and the transparent electrodes 122, 124.

Figure 2:
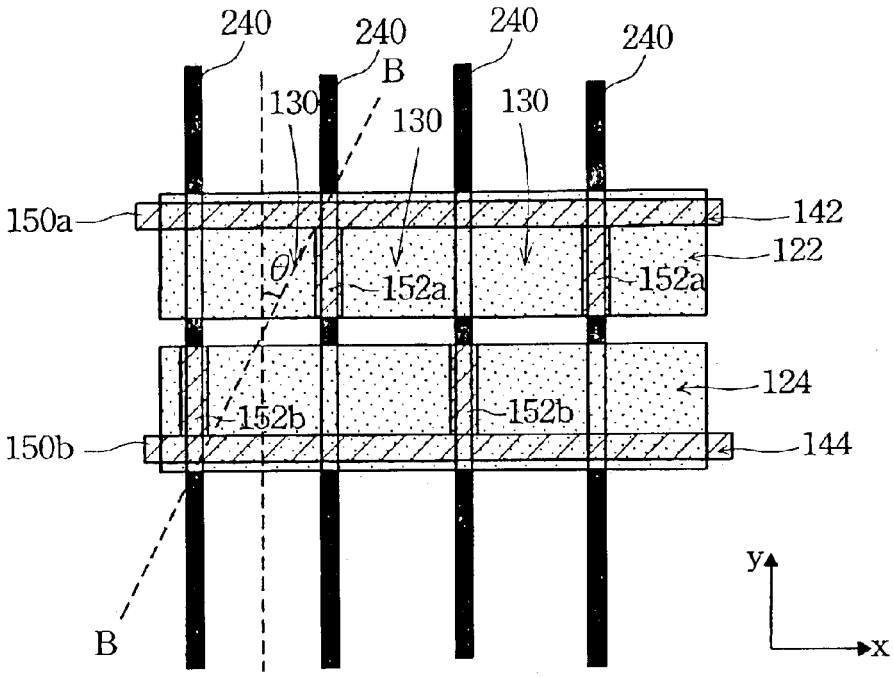
FIG. 2 is a schematic plan view according to one preferred embodiment of the present invention.

FIG. 2 is a schematic plan view of a discharge electrode structure according to one preferred embodiment of the present invention. Referring to FIG. 2, several pairs of electrodes are parallel arranged, wherein each pair of the electrodes includes a pair of transparent electrodes 122, 124 and a pair of opaque electrodes 142, 144. A plurality of barrier ribs 240 such as linear strips is parallel arranged, which is perpendicular to the pairs of electrodes. A plurality of address electrodes (not shown) is respectively disposed between the barrier ribs 240. Therefore, the barrier ribs 240 and the address electrodes are alternately disposed. In other words, one address electrode is located between two adjacent barrier ribs 240. By the arrangement of the barrier ribs 240 and the pairs of the electrodes, a plurality of luminant cells 300 are array scaled therein.

The transparent electrodes 122, 124 are made of transparent conductive materials, such as Indium tin oxide (ITO). In this embodiment, the transparent electrodes 122, 124 have a shape of bar, and parallel disposed to have a narrow gap therebetween. One of the transparent electrodes 122, 124 is used for a common electrode, and the other is used for a scan electrode. A discharge center is therefore produced between the transparent electrodes 122, 124. The transparent electrodes 122, 124 transmit the lights emitted from a fluorescent layer coated in the luminant cells 130 to produce required visual image.

The opaque electrodes 142, 144 include a pair of conductive electrodes 150*a*, 150*b* disposed on opposite sides of the transparent electrodes 122, 124 where are adjacent to the edge of the luminant cells 130. The opaque electrodes 142, 144 respectively have a plurality of expanding electrodes 152*a*, 152*b* between the pair of conductive electrodes 150*a*, 150*b*. Each of the expanding electrodes 152*a*, 152*b* are located between the luminant cells 130, and preferably aligns underneath barrier rib 240. The expanding electrodes 152*a* are coupled to the conductive electrode 150*a*, and the expanding electrodes 152*b* are coupled to the conductive electrode 150*b*. The expanding electrodes 152*a*, 152*b* are alternately coupled to the conductive electrode 150*a*, 150*b*, i.e. the expanding electrodes 152*a*, 152*b* are arranged in a sequence of alternation. By this arrangement, each luminant cell 130 has two expanding electrodes 152*a* and 152*b* that are oblique symmetrically located at opposite corners.

When a signal is applied to a specific luminant cell 130, an larger electric field is produced between the expanding electrodes 152*a*, 152*b*, so that ionized particles are accelerated in the B—B direction and thus is readily arrested by the barrier ribs 240. Fewer the ionized particles are scattered into adjacent non-luminant region or luminant cell, and thereby error discharge issue can be modified.

Figure 3:
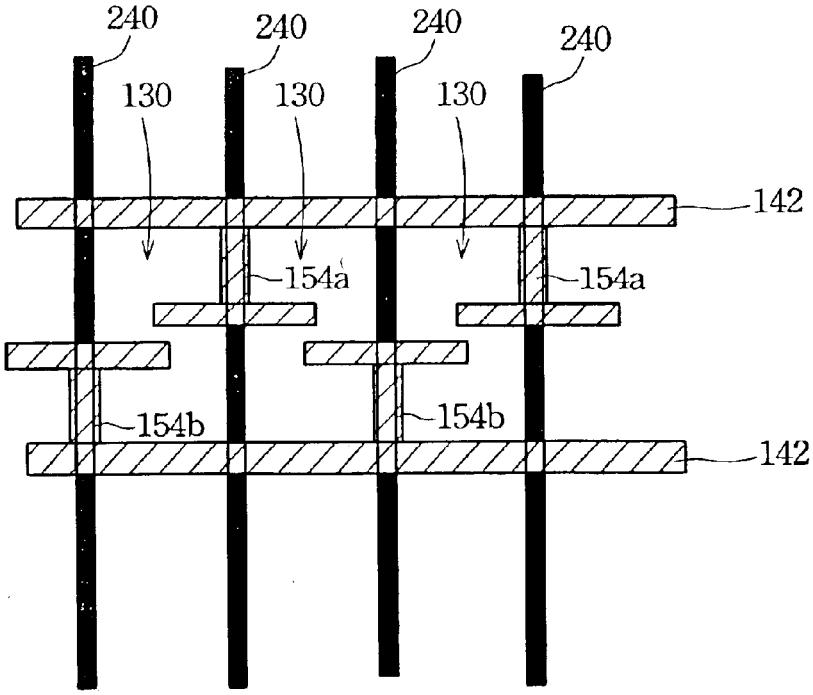
FIG. 3 is a schematic plan view according to one preferred embodiment of the present invention.

The oblique symmetric discharge electrode structure of the present invention also can be modified under the spirit and scope of the present invention. Referring to FIG. 3, T-type expanding electrodes 154*a*, 154*b* can be used to replace the bar-like expanding electrodes 152*a*, 152*b*. The T-type expanding electrodes 154*a*, 154*b* have two horns where is adjacent to the discharge center. It is therefore to obtain better luminance performance by the T-type expanding electrodes 154*a*, 154*b*.

Figure 4:
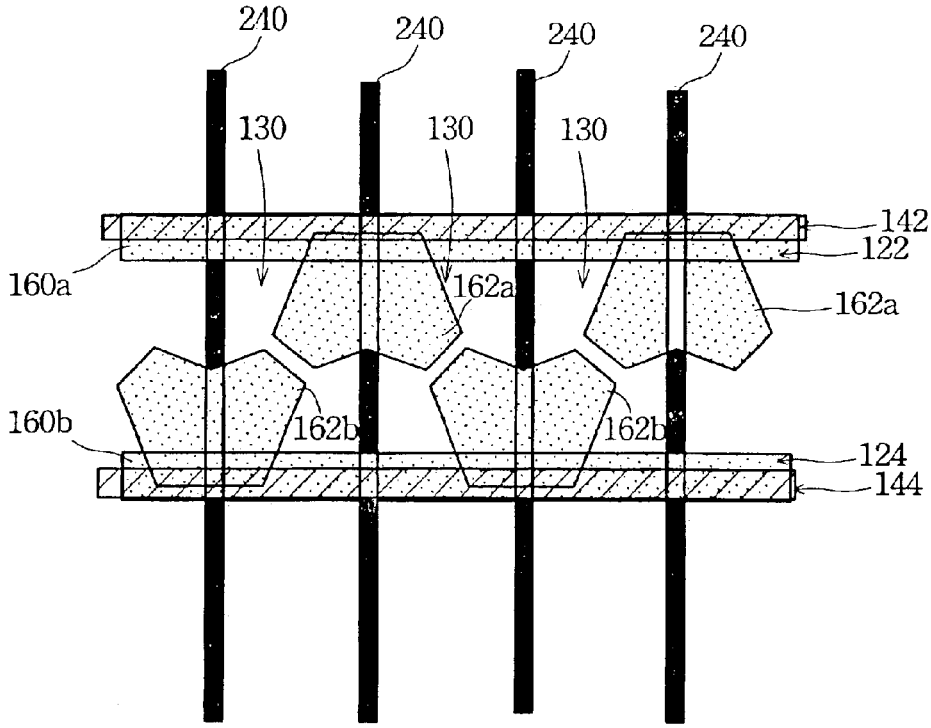
FIG. 4 is a schematic plan view according to one preferred embodiment of the present invention.

In addition, besides modifying the opaque electrodes 142, 144, the oblique symmetric expanding electrodes also can be applied to the transparent electrodes 122, 124. FIG. 4 is a schematic plan view of a discharge electrode structure according to one preferred embodiment of the present invention. Referring to FIG. 4, a pair of linear opaque electrodes 142, 144 is disposed at the edges of the luminant cells 130 in one row. A pair of transparent electrodes 122, 124 is combined to the opaque electrodes 142, 144, respectively. The transparent electrodes 122, 124 include a pair of transparent conductive electrodes 160*a*, 160*b* aligned to the opaque electrodes 142, 144. The conductive electrodes 160*a*, 160*b* respectively have a plurality of fan-type transparent expanding electrodes 162*a*, 162*b* between the conductive electrodes 150*a*, 150*b*. The expanding electrodes 162*a*, 162*b* are alternately coupled to the conductive electrodes 160*a*, 160*b*. The fan-type expanding electrodes 162*a*, 162*b* both have a symmetric structure. By utilizing the fan-type expanding electrodes 162*a*, 162*b*, the area of the transparent electrodes 122, 124 can be greatly decreased, such that capacitance effect of the transparent electrodes 122, 124 can be eliminated to improve luminance performance.

Figure 5:
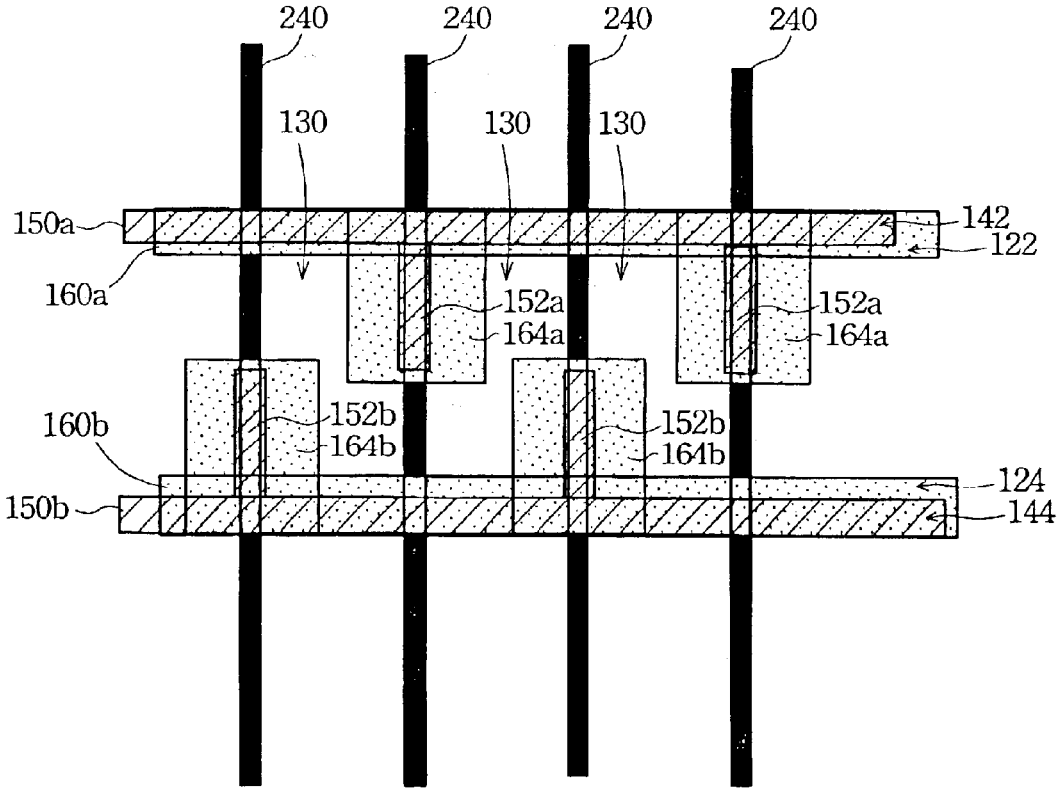
FIG. 5 is a schematic plan view according to one preferred embodiment of the present invention.

In another case, the oblique symmetric expanding electrodes can be applied to the transparent electrodes 122, 124 and the opaque electrodes 142, 144 at the same time. FIG. 5 is a schematic plan view of a discharge electrode structure according to one preferred embodiment of the present invention. Referring to FIG. 5, the structure of the opaque electrodes 142, 144 is the same to the opaque electrodes 142, 144 of FIG. 2. The detail description of the opaque electrodes 142, 144 is referred to above embodiment. Regarding to the transparent electrodes 142, 144, they are combined to the opaque electrodes 142, 144, respectively. The transparent electrodes 122, 124 include a pair of transparent electrodes 160*a*, 160*b* aligned to the opaque conductive electrodes 150*a*, 150*b*. A plurality of quadratic transparent expanding electrodes 164*a*, 164*b* are alternately coupled to the conductive electrodes 160*a*, 160*b*. The quadratic transparent expanding electrodes 164*a*, 164*b* respectively located on the opaque expanding electrodes 152*a*, 152*b*. By combination of the transparent expanding electrodes 164*a*, 164*b* to the opaque expanding electrodes 152*a*, 152*b*. The discharge performance can be increased because the opaque expanding electrodes 152*a*, 152*b* enhance the conductivity of the transparent expanding electrodes 164*a*, 164*b*.

Figure 6:
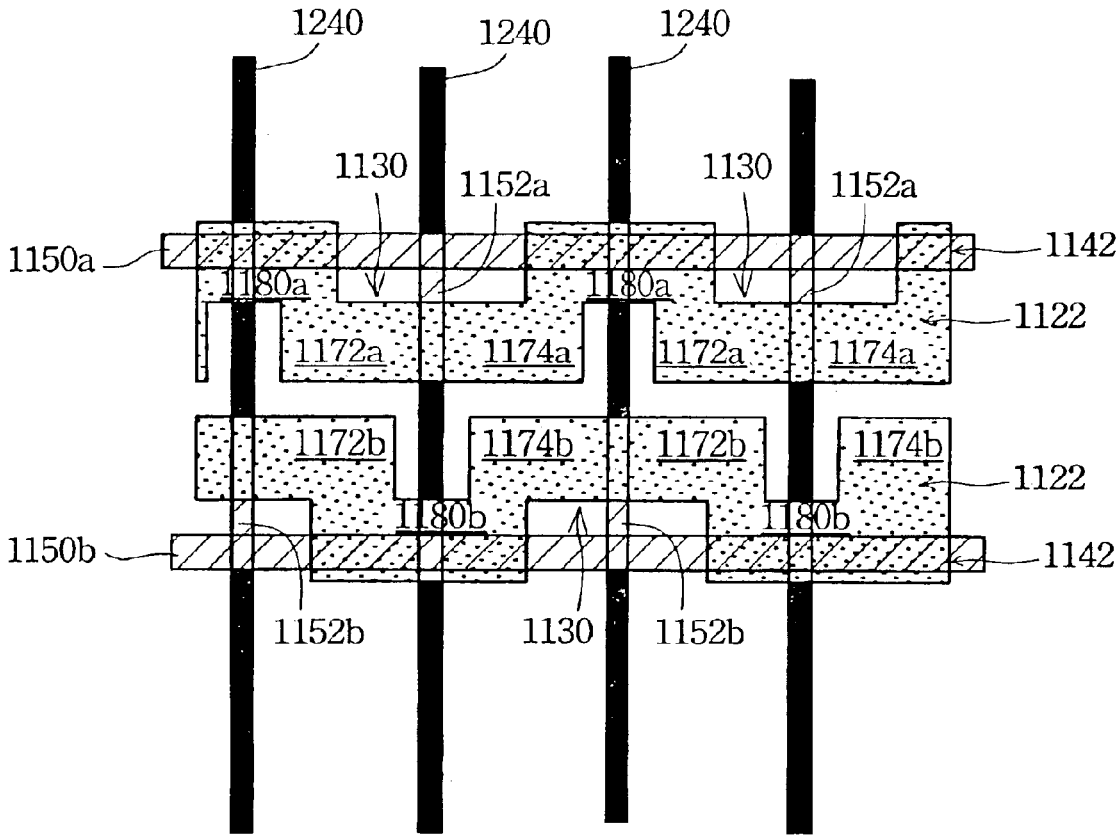
FIG. 6 is a schematic plan view according to one preferred embodiment of the present invention.

The present invention further provides a pair of meandrous transparent electrodes that have the advantages of foregoing expanding electrodes. FIG. 6 is a schematic plan view of a discharge electrode structure according to one preferred embodiment of the present invention. Referring to FIG. 6, as similar to above embodiment, a plurality of barrier ribs 1240 such as linear strips is parallel arranged. A plurality of address electrodes (not shown) is respectively disposed between the barrier ribs 1240. Therefore, the barrier ribs 1240 and the address electrodes are alternately disposed. Several pairs of electrodes are parallel arranged, which are perpendicular to the barrier ribs 1240. Each pair of the electrodes includes a pair of transparent electrodes 1122, 1124 and a pair of opaque electrodes 1142, 1144. By the arrangement of the barrier ribs 1240 and the pairs of the electrodes, a plurality of luminant cells 1130 are array scaled therein.

The opaque electrodes 1142, 1144 include a pair of conductive electrodes 1150*a*, 1150*b* disposed at the edges of the luminant cells 1130. The opaque electrodes 1142, 1144 respectively have a plurality of expanding portions 1152*a*, 1152*b* between the pair of conductive electrodes 1150*a*, 1150*b*. Each of the expanding portions 1152*a*, 1152*b* are located between the luminant cells 1130, and preferably aligns underneath barrier rib 240. The expanding portions 1152*a*, 1152*b* are alternately coupled to the conductive electrodes 1150*a*, 1150*b*. By this arrangement, each luminant cell 1130 has two expanding portions 1152*a* and 1152*b* that are oblique symmetrically located at opposite corners.

The meandrous transparent electrodes 1122, 1124 include a plurality of connecting portions 1180*a* 1180*b*, and a plurality of discharge portions 1172*a*, 1174*a* and 1172*b*, 1174*b*. The connecting portions 1180*a*, 1180*b* are respectively connected to parts of the conductive electrodes 1142, 1144 where each connected part is between the expanding portions 1152*a* or 1152*b*. Therefore, the connecting portions 1180*a* and the expanding portions 1152*a* are disposed in a sequence of alternation, and similar to the connecting portions 1180*b* and the expanding portions 1152*b*. The discharge portions 1172*a*, 1174*a* are coupled to the connecting portions 1180*a* to construct the meandrous transparent electrodes 1122. Similarly, the discharge portions 1172*b*, 1174*b* are coupled to the connecting portions 1180*b* to construct the transparent electrodes 1124. The discharge portions 1172*a*, 1174*a* are coupled to the expanding portion 1152*a*, and the discharge portions 1172*b*, 1174*b* are coupled to the expanding portion 1152*b* to enhance the conductivity. By the arrangement, each luminant cell 1130 has two discharge portions 1172*a*, 1172*b* or 1174*a*, 1174*b* that are oblique symmetrically located at opposite corners. In this embodiment, the connecting portion 1180*a* and adjacent expanding portions 1172*a*, 1174*a* constitute an expanding electrode, and similar to the connecting portion 1180*b* and expanding portions 1172*b*, 1174*b*.

In each luminant cell 1130, a pair of expanding portions 1172*a*, 1172*b* or 1174*a*, 1174*b* are oblique symmetrically disposed. When a signal is applied to a specific luminant cell 1130, gas discharge occurs, and ionized particles are accelerated in a direction inclined to the y direction because of the oblique symmetric expanding portions 1172*a*, 1172*b* or 1174*a*, 1174*b*. Therefore, the accelerated particles can be blocked down by the barrier ribs 1240 without scattering into adjacent non-luminant region or luminant cell, so that error discharge issue can be decreased.

According to above description, the present invention provides a discharge electrode structure of a plasma display panel in which having oblique symmetric expanding electrodes located at opposite corners of each luminant cells. The oblique symmetric expanding electrodes can rotate accelerated direction of ionized particles to avoid scattering into adjacent non-luminant regions. Error discharge issue can be prevented. Moreover, parasitic capacitance can be decreased because of effective gap between the transparent electrodes increased.

As is understood by a person skilled in the art, the foregoing preferred embodiments of the present invention are illustrative of the present invention rather than limiting of the present invention. It is intended to cover various modifications and similar arrangements included within the spirit and scope of the appended claims, the scope of which should be accorded the broadest interpretation so as to encompass all such modifications and similar structure.

What is claimed is:

1. A discharge electrode structure of a plasma display panel to control gas discharge of a plurality of luminant cells in one row, comprising:

a pair of conductive electrodes parallel located on the edge of said luminant cells in one row; and a plurality of expanding electrodes located between said pair of conductive electrodes, each of said expanding electrodes being located between said luminant cells, and said expanding electrodes alternately coupled to said pair of conductive electrodes to oblique symmetrically locate at opposite corners of each luminant cell.

2. The structure according to claim 1, wherein said conductive electrode includes a bus electrode.

3. The structure according to claim 1, wherein said expanding electrode includes a bar perpendicular to said conductive electrode.

4. The structure according to claim 1, wherein said expanding electrode includes a T-type electrode.

5. The structure according to claim 1, wherein said conductive electrode includes a transparent electrode.

6. The structure according to claim 1, wherein said expanding electrode includes a fan-type electrode.

7. The structure according to claim 1, wherein said expanding electrode aligns a barrier rib that is between two luminant cells.

8. The structure according to claim 1, wherein said expanding electrode has a symmetric structure.

9. A discharge electrode structure of a plasma display panel to control gas discharge of a plurality of luminant cells in one row, comprising:

a pair of conductive electrodes parallel located on the edge of said luminant cells in one row, said pair of conductive electrodes including a plurality of expanding portion, said expanding portions alternately expanded from said conductive electrodes and located between said luminant cells; and a pair of meandrous transparent electrodes including a plurality of connecting portions and a plurality of discharge portions, said connecting portions connected to parts of said conductive electrodes between said expanding portions, each of said discharge portions connected to said expanding portion and said connecting portions to oblique symmetrically locate at opposite corners of each luminant cell.

10. The structure according to claim 9, wherein said expanding portion comprises a bar perpendicular to said conductive electrode.

11. The structure according to claim 9, wherein said expanding portion aligns a barrier rib that is between two luminant cells.

12. The structure according to claim 9, wherein said discharge portion has a symmetric structure.

13. A discharge electrode structure of a plasma display panel to control gas discharge of a luminant cell, comprising:

a pair of expanding electrodes oblique symmetrically located at opposite corners of said luminant cell.

14. The structure according to claim 13, wherein a material of said expanding electrodes includes an opaque conductive material.

15. The structure according to claim 13, wherein said expanding electrode includes a bar.

16. The structure according to claim 13, wherein said expanding electrode includes a T-type electrode.

17. The structure according to claim 13, wherein a material of said expanding electrodes includes a transparent conductive material.

18. The structure according to claim 13, wherein said expanding electrode includes a fan-type electrode.

19. The structure according to claim 13, wherein said expanding electrode aligns a barrier rib at the edge of said luminant cell.

* * * * *